US010190381B2

(12) United States Patent
Hilpert et al.

(10) Patent No.: US 10,190,381 B2
(45) Date of Patent: Jan. 29, 2019

(54) VARIABLE RATIO ROTARY ENERGY CONTROL DEVICE FOR A BLOWOUT PREVENTER SAFETY DEVICE

(71) Applicant: HilFlo, LLC, Conroe, TX (US)

(72) Inventors: Clifford Lee Hilpert, Conroe, TX (US); Jeffrey Lee Hilpert, Conroe, TX (US)

(73) Assignee: HilFlo, LLC, Conroe, TX (US)

( * ) Notice: Subject to any disclaimer, the term of this patent is extended or adjusted under 35 U.S.C. 154(b) by 573 days.

(21) Appl. No.: 14/733,921

(22) Filed: Jun. 8, 2015

(65) Prior Publication Data

US 2016/0040500 A1 Feb. 11, 2016

Related U.S. Application Data

(60) Provisional application No. 62/033,317, filed on Aug. 5, 2014.

(51) Int. Cl.
*E21B 33/06* (2006.01)
*E21B 34/16* (2006.01)

(52) U.S. Cl.
CPC ..... *E21B 33/06* (2013.01); *E21B 34/16* (2013.01)

(58) Field of Classification Search
CPC ..... E21B 33/06; E21B 34/16; E21B 33/0355; E21B 33/064
USPC ..... 60/413, 490
See application file for complete search history.

(56) References Cited

U.S. PATENT DOCUMENTS 8,413,436 B2 * 4/2013 Li ..... B60K 6/12 60/415
8,523,533 B1 * 9/2013 Best ..... F04B 1/32 417/46
8,779,614 B2 * 7/2014 Yarnold ..... E21B 41/0085 290/54
9,115,705 B2 * 8/2015 Best ..... E21B 43/129
9,670,755 B1 * 6/2017 Lugo ..... E21B 43/0122
2012/0088134 A1 * 4/2012 Wood ..... E21B 33/064 429/90
2012/0305258 A1 * 12/2012 Baugh ..... E21B 43/01 166/344
2013/0333894 A1 * 12/2013 Geiger ..... E21B 33/0355 166/336

* cited by examiner

*Primary Examiner* — Thomas E Lazo
(74) *Attorney, Agent, or Firm* — Tumey L.L.P.

(57) ABSTRACT

A method and apparatus for activating a safety device of a blowout preventer utilizes a variable ratio rotary energy controller. The controller automatically adjusts the pressure of the fluid for activating the safety device thereby conserving the amount of energy required for each activating cycle. The controller includes a variable displacement hydraulic motor coupled to a variable displacement hydraulic pump. A system for recharging the activating fluid circuit allows for the actuating system to be reused as needed.

8 Claims, 5 Drawing Sheets

VARIABLE RATIO ROTARY ENERGY CONTROL DEVICE FOR A BLOWOUT PREVENTER SAFETY DEVICE

CROSS-REFERENCE TO RELATED APPLICATIONS

This application claims priority to U.S. Provisional Patent Application No. 62/033,317, filed on Aug. 5, 2014, titled "Variable Ratio Energy Actuator for a Blow Out Preventer Safety Device," the entire disclosures of which are incorporated herein by reference.

BACKGROUND OF INVENTION

1. Field of the Invention

Oil and Gas Exploration risk management includes the ability to control subsurface pressures which may be encounter during drilling operation. The primary mechanism utilized by operators to control downhole pressures is the hydrostatic pressure as a result of the drilling fluid contained within the wellbore. The drilling fluid is engineered and formulated to a density that provides a hydrostatic pressure inside of the wellbore that is greater than the formation pressure being drilled. In the majority of drilling operations, the hydrostatic control of wellbore pressure is adequate. However, from time-to-time the operator may encounter a higher than expected formation pressure where there is not adequate hydrostatic pressure to control the wellbore pressure. During these times the operator relies on a series of mechanical controls to stabilize the wellbore and prevent a "Blowout". A blowout is the uncontrolled release of fluid or gas from the wellbore. This event is extremely dangerous and therefore must be avoided if at all possible. The primary mechanical control device utilized by operators to control wellbore pressure is the Blowout Preventer (BOP) assembly. The BOP assembly consists of multiple sealing and shearing devices that are hydraulically actuated to provide various means of sealing around the drill string or shearing it off entirely thereby completely sealing the wellbore. A hydraulic pressure source and a means of controlling the hydraulic fluid under pressure are required for proper BOP operation.

2. Description of Related Art

Typically hydraulic pressure is provided by utilizing high pressure hydraulic accumulators and a control panel near the drilling platform. These accumulators are typically charged to 3000 PSIG but in some case to a higher pressure. In testing or actual operation a series of hydraulic valves are opened to direct the flow of high pressure hydraulic fluid to the appropriate pressure control device of the BOP assembly. To operate as designed the hydraulic fluid received at the BOP assembly must be at a pressure equal to or greater than the minimum required by the manufacture or governing body. Typical land-based surface BOP systems require a minimum of 1200 psi to operate as designed. In the current state of the art systems the relationship between the hydraulic accumulator pressure and the hydraulic pressure available to operate the BOP is 1 to 1. For example if the accumulator hydraulic pressure is 2,250 PSIG then the hydraulic pressure available to operate the BOP assembly is 2,250 PSIG. As hydraulic fluid is expelled from the accumulators to operate the BOP assembly the hydraulic pressure of the accumulator will decrease. At some point the hydraulic pressure in the accumulator will not be sufficient to operate the BOP assembly. This minimum acceptable hydraulic pressure level is typically set at 1,200 PSIG but may be more or less depending on the actual BOP setup. The rate at which the pressure decreases in an accumulator is proportional to the volume of fluid discharged from the accumulators. This is defined by Boyle's law P1 V1=P2 V2. Applying this to a typical 15 gallon hydraulic accumulator utilize on drilling rig we find:

Volume at 1,000 PSIG per charge level: 15 gallons

Volume at 1,200 PSIG minimum pressure level: 12.5 gallons

Volume at 3,000 PSIG maximum pressure level: 5 gallons

Working volume (12.5-5)=7.5 gallons.

Working from the example above it is reasonable to expect 7.5 gallons of hydraulic fluid at a minimum of 1,200 PSIG from each accumulator in the accumulator rack. The number of accumulator bottles in a typical accumulator rack vary significantly based on the hydraulic requirements of the various BOP assemblies. For illustrative purposes, a typical 20 tank accumulator rack and a typical surface BOP assembly will be utilized in the subsequent example. Based on the previous calculation above, it is reasonable to expect 150 gallons of hydraulic fluid at a minimum of 1,200 PSIG from the accumulator rack.

Proper BOP operation is critical for safe Oil and Gas Exploration activities. The American Petroleum Institute (API), a widely recognized trade origination, has developed standards related to the manufacturing and testing of BOP assemblies. A typical test of the BOP assembly of this example, in accordance with the guidelines of API 53, would require approximately 75 gallons of hydraulic fluid at a minimum pressure of 1,200 PISG. From the previous example above, it is reasonable to expect 150 gallons of hydraulic fluid at a minimum of 1,200 PSIG from the accumulator rack. Therefore it is reasonable to expect that the accumulator rack could supply sufficient pressurized hydraulic fluid to complete two API 53 tests with each test consuming approximately 75 gallons of pressurized hydraulic fluid. Subsequent to these test it is necessary to recharge the accumulator rack utilizing a hydraulic pump. This pump could be either pneumatic or electric. Additionally these pumps can be utilized as an emergency hydraulic power source for the BOP if the accumulator rack is fully depleted due to an anomaly or unforeseen situation. A disadvantage to this system is the very limited amount of pressurized hydraulic fluid available before recharging is required. Recharging requires a power source which may not be available during an extreme emergency situation. Another disadvantage of this system is the inefficiency associated with the control of hydraulic fluid discharged from the accumulators as it is utilized to operate the BOP system. In a typical BOP operation the initial ram closing cycle does not require 1200 psi. In fact the initial portion of the ram closing cycle can be accomplished with as little as 250 psi. The initial closing cycle may be as much as 75% of the complete closing cycle. The pressure required for the subsequent remaining 25% of the cycle will increase exponentially to approximately 1,200 psi depending on the BOP system and drill string being utilized. The hydraulic energy discharged from the accumulator bank during a closing cycle is equal to the pressure of the accumulator bank and the flow rate of the discharge. The discharge flow rate from the accumulator bank to the BOP system is controlled by a flow control valve. As previously stated the initial pressure of the accumulator bank is approximately 3,000 psi but the first initial 75% of the closing cycle only requires 250 psi. During this phase of the ram closing cycle the flow rate is regulated by the flow control valve. The energy discharged from the accumulator bank during the closing cycle is directly related to the flow and pressure of the hydraulic fluid discharged by the accumulator bank. The energy consumed by the BOP ram is also directly related to the inflow and pressure required to operate the ram. The energy difference or imbalance between that discharged by the accumulator bank and that consumed by the BOP ram is lost as heat at the flow control valve. The energy loss can be substantial. For example, during the very first part of the ram closing cycle the accumulator energy discharge is approximately 15 times greater than that required by the BOP. This can be established by looking at the flow and pressure relationship between of the accumulator rack and the BOP closing ram. The flow rate of the hydraulic fluid discharged at the accumulator rack is equal to the flow rate of the hydraulic fluid consumed by the BOP closing ram. However the pressure discharged at the accumulator rack is initially 3,000 psi but the pressure required at the BOP closing ram is only 250 psi. Therefore, the energy ratio is 12 to 1 (3,000/250). The balance of energy is heat loss from the pressure drop across the control valve. Also note that the accumulator rack is at the highest pressure when the BOP closing rams operating pressure requirement is the lowest. As the accumulator rack pressure decreases linearly with the discharge of hydraulic fluid, the pressure requirement of the BOP ram will increase. As some point near the end of the BOP ram closing cycle the pressure requirement will have increased to approximately 1,200 psi. If the accumulator pressure is less than 1,200 psi it will not be able to fully close the BOP ram. FIG. 7 depicts the energy relationship between the accumulator rack and the BOP ram.

It is much more preferable to more efficiently utilize the stored energy of the accumulator rack to extend its capacity and usefulness to operate the BOP systems. The ideal system would automatically increase or decrease the energy use ratio between the pressure available at the accumulator rack and that required by the BOP closing ram during the entire closing cycle or any other BOP operation.

BRIEF SUMMARY OF THE INVENTION

An apparatus that could automatically adjust the energy use ratio between the pressure at the accumulator rack and the BOP closing ram can be described as a Variable Ratio Rotary Energy Controller (VRREC).

One such embodiment of a Variable Ratio Rotary Energy Controller includes a variable displacement rotary hydraulic pump directly connected by a mechanical coupling to a variable displacement hydraulic motor. The Variable Ratio Rotary Energy Controller precisely matches the energy consumed from the accumulator to that required to operate the BOP during the entire BOP operation cycle. This is achieved by automatically adjusting the ratio between the variable displacement hydraulic motor and the variable displacement pump to precisely match the pressure ratio between the pressure available at the accumulator bank and that required by the BOP closing ram during the entire closing cycle or any other BOP operation. For example: the required pressure at the BOP when the BOP ram is 50% closed is approximately 250 psi (see chart). If at that point in the cycle the accumulator bank has a pressure of 2,500 psi during this part of the closing cycle the Variable Ratio Rotary Energy Controller would have a ratio of 10 to 1. This means that for each gallon consumed from the accumulator bank, 10 gallons are delivered to the BOP system. In the same example, if the accumulator bank has a pressure of 1,000 psi then the Variable Ratio Rotary Energy Controller would have a ratio of 4 to 1 (1,000/250=4). In a different example, the required pressure at the BOP when the BOP ram is 90% closed is approximately 900 psi (see chart). If at that point in the cycle the accumulator bank has a pressure of 300 psi during this part of the closing cycle the Variable Ratio Rotary Energy Controller would have a ratio of 0.33 to 1 (300/900=33). In this example it is evident that the Variable Ratio Rotary Energy Controller also allows for utilization of the stored energy in the accumulator rack at a pressure significantly lower that required at the BOP system. Utilizing the full potential of the Variable Ratio Rotary Energy Controller can extend the usefulness of the accumulator bank by approximately 350% depending on the type of BOP operation and setup.

An additional benefit of the VRREC is that it allows utilization of continuously recharged low pressure accumulators as the primary source of pressurized hydraulic fluid. In such a system the primary low pressure gas source could be a simple liquid nitrogen tank with an operating pressure of 400 psi. This low pressure gas source would be connected to the gas side of the accumulators in the accumulator bank. As a volume of hydraulic fluid was discharged from the accumulators an equal volume of gas would be introduce into the gas side of the accumulators of the accumulator bank. This would allow the accumulator bank to maintain 400 PSI regardless of the hydraulic volume and the entire hydraulic volume of the accumulator would be usable.

BRIEF DESCRIPTION OF THE SEVERAL VIEWS OF THE DRAWING(S)

DETAILED DESCRIPTION OF THE INVENTION

Figure 1:
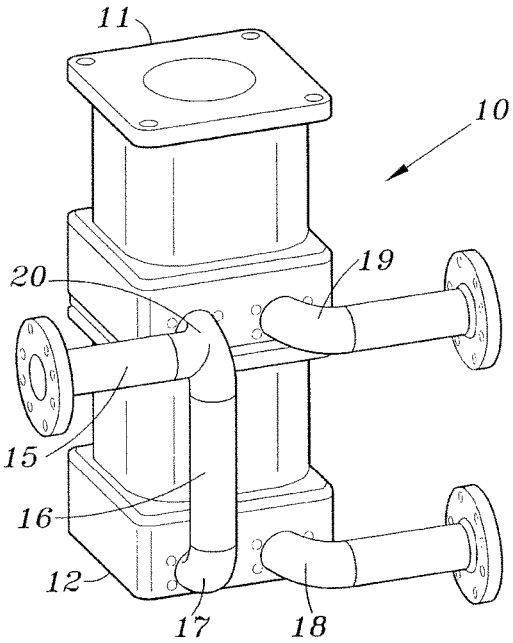
FIG. 1 is a perspective view of a variable ratio rotary energy controller according to an embodiment of the invention.
Figure 6:
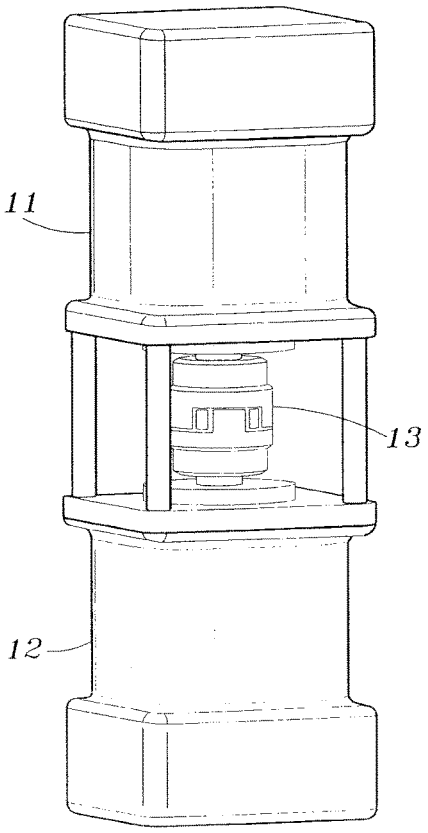
FIG. 6 is a perspective view showing the coupling between the motor portion and pump portion of the variable ratio rotary energy controller.
Figure 2:
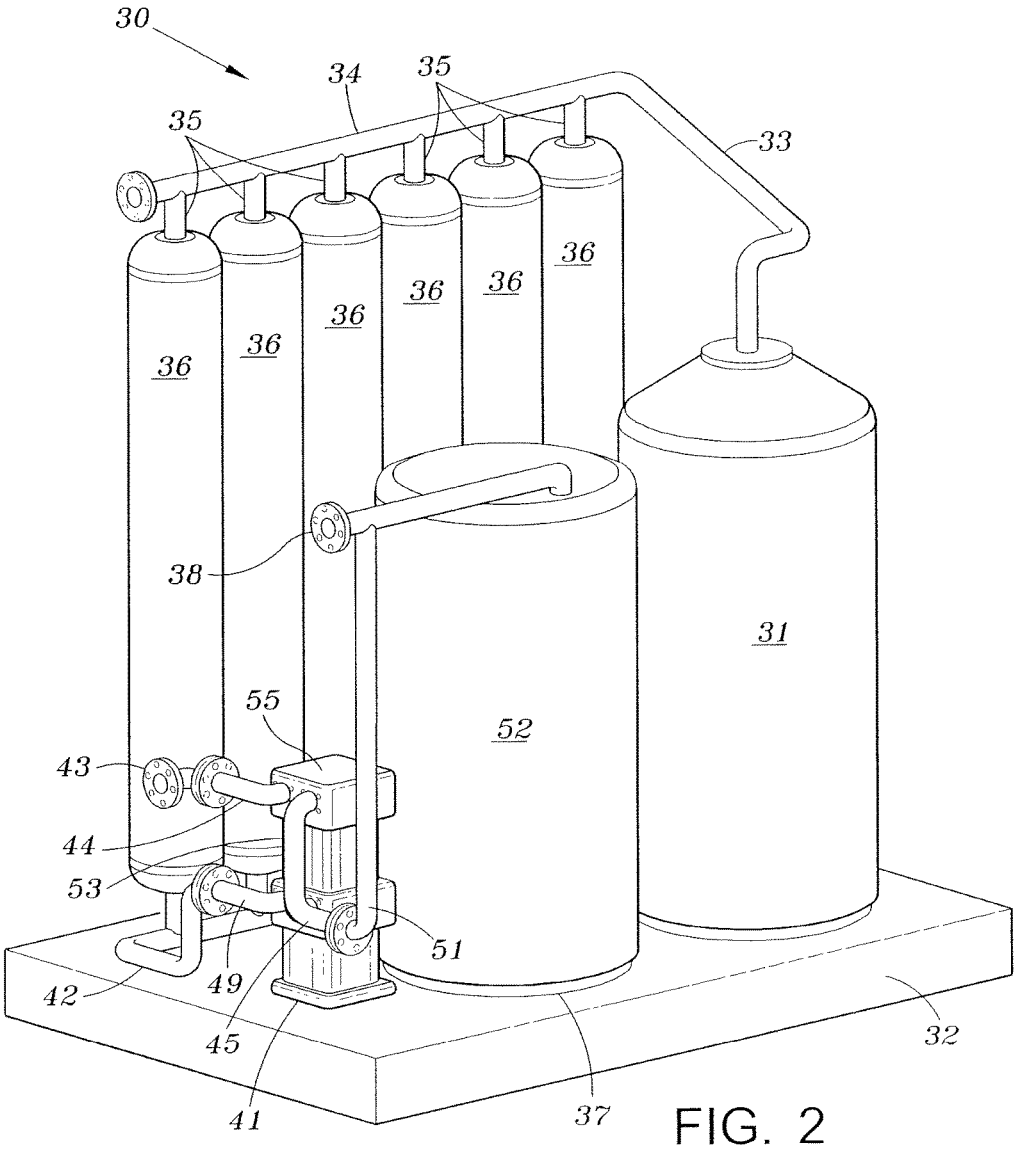
FIG. 2 is a perspective view of a first embodiment of a hydraulic pressurized fluid source for a blowout preventer incorporating a variable ratio rotary energy controller.

An example of an embodiment of a variable ratio rotary energy controller (VRREC) is illustrated in FIG. 1. The VRREC includes a hydraulic motor 11 having an output shaft directly coupled to an input shaft of a hydraulic pump 12. Hydraulic fluid under pressure is supplied via input conduit 19 to the motor 11. Fluid exits the motor via a "T" coupling 20. Part of the fluid may be directed towards or away from the motor via conduit 15 and a portion may be directed to the fluid input conduit 17 of the pump. The amount of fluid going to the pump is automatically determined by the pressure requirements of the blowout preventer safety device. Pressurized fluid is directed away from pump 12 through outlet 18. One embodiment of a system 30 for utilizing the VRREC is shown in FIG. 2. The system 30 may be mounted on a platform which may be part of a surface vessel. The system includes a plurality of accumulators 36 connected to a gas supply vessel or generator 31 via a manifold 34 and a plurality of branch conduits 35. Fluid is supplied to the hydraulic motor portion 41 of the VRREC through conduit 42. Fluid exits motor 41 through outlet tee 45 which directs fluid into either hydraulic tank 52 via conduit 51 or to the inlet of pump portion 55 via conduit 53 depending on the energy requirements of the blowout perventer safety device. Fluid under relatively high pressure exits pump portion 55 of the VRREC via conduit 44 and from there is connected to the blowout preventer safety device.

Figure 3:
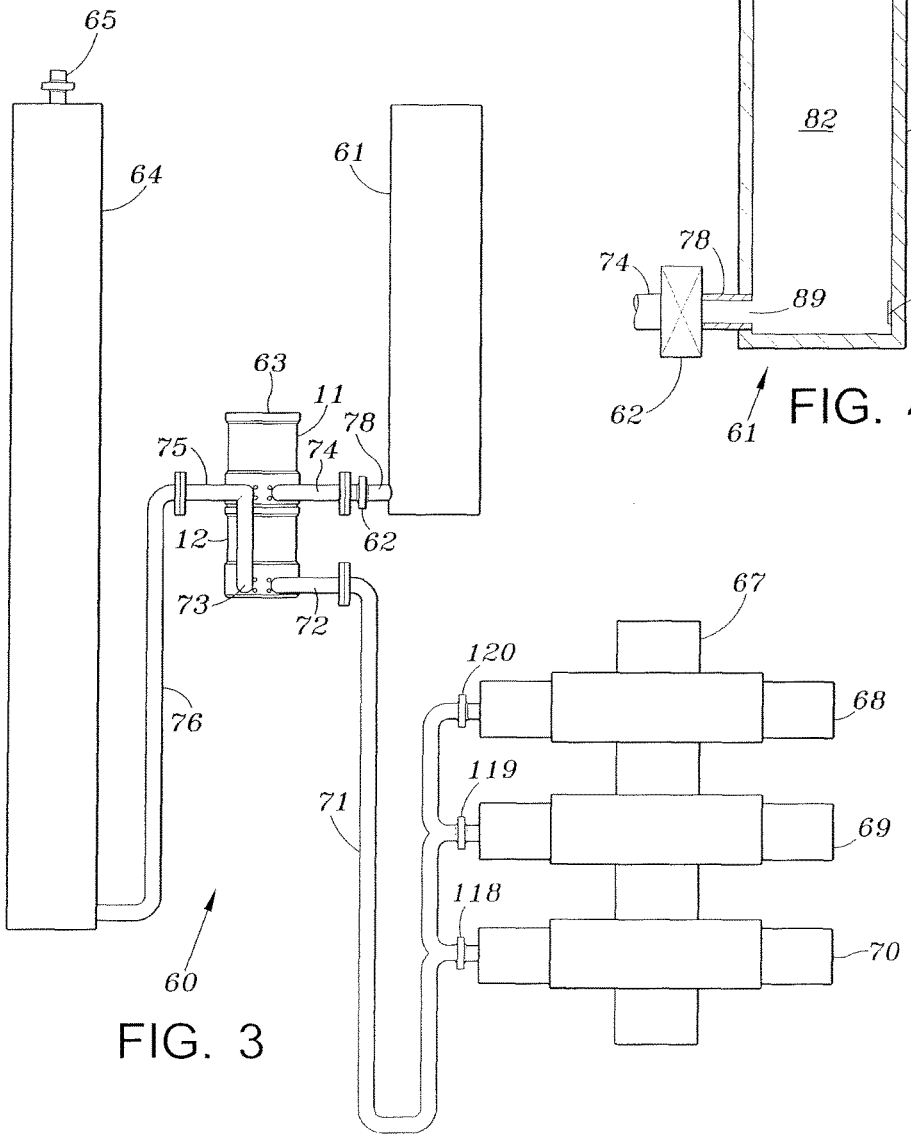
FIG. 3 is a diagram of a non-rechargeable fluid pressure system for a blowout preventer using a variable ratio rotary energy controller according to a second embodiment of the invention.
Figure 4:
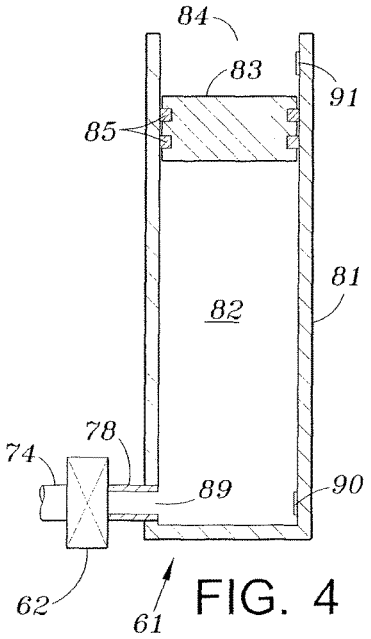
FIG. 4 is a cross-sectional view of the fluid reservoir 61 of the embodiment of FIG. 3.

FIGS. 3 and 4 illustrate a second embodiment of a system 60 according to the invention. This system is adapted to be positioned at or near the sea floor and uses hydrostatic sea water pressure as the pressure source of the hydraulic fluid. In this embodiment, a first vessel 61 is connected to the VRREC 63 via a control valve 62. As shown in FIG. 4, vessel 61 is open at its top at 84. A floating position 83 having seals 85 is positioned within the vessel. The area 82 below piston 83 is filled with hydraulic fluid. A port 89 is formed in the lower portion of the vessel and a valve 62 is in fluid communication with port 89 and hence with the lower portion of vessel 61 via a conduit 78. Fluid within the lower portion 82 of vessel 61 is pressurized by the hydrostatic pressure present at the top of piston 83.

Upon opening of valve 62, fluid within portion 82 of vessel 61 is directed to the hydraulic motor portion 11 of the VRREC via conduits 78 and 74 shown in FIGS. 3 and 4. Fluid exits the motor portion 11 of the VRREC and is directed to either container 64 through conduit 75 or to the pump portion 12 through conduit 73 depending on the pressure requirement for activation of the control devices 68, 69 and 70 on the blowout preventer 67. Actuating pressurized fluid exits pump portion 12 through conduits 72 and 71 to any one of the safety devices 68, 69 or 70 via valves 120, 119 and 118 for actuating the safety device in response to a sensed condition that would require the safety device to be activated. Safety devices 68, 69 and 70 may be sealing and/or shearing devices as is well known in the art.

Container 64 collects hydraulic fluid at a relatively low pressure and includes an evacuation valve 65.

Operation of the system is as follows. In the normal "ready to operate" state the piston 83 is displaced to a position closest to the open end of vessel 61. The space between the opposite side of the piston and the closed end of the vessel 61 is filled with hydraulic fluid. The vessel is configured with a hydraulic discharge port 89 to allow the release of hydraulic fluid between the piston and the closed end of the vessel via flow control valve 62. The flow control valve 62 is connected to the VRREC. The discharge port is arranged to allow substantially all of the hydraulic fluid between the piston and the closed end of the vessel to be discharged by the hydrostatic seawater pressure. A container 64 is arranged to receive or supply hydraulic fluid to or from the VRREC. The container 64 has a volume approximately equal to 1.5 times the volume of vessel 61 and the combined volume of the BOP closing cylinders attached to the system. The container is sealed other than the hydraulic fluid connection to the VRREC and an evacuation port 65. The container is designed to receive hydraulic fluid from vessel 61 and supply hydraulic fluid to the VRREC during normal operations. In the embodiment of FIG. 4 the container 64 also receives hydraulic fluid discharged from the BOP system. The normal "ready to operate" state of container 64 is near zero PSIA and principally void. When the flow control valve 62 is open, hydraulic fluid will flow from vessel 61 through the VRREC and into container 64. The floating piston 83 of the vessel will displace towards the closed end of the vessel. The displaced hydraulic fluid will be received by the VRREC at the VRREC low pressure intake port. The displacement of hydraulic fluid will cause the variable displacement hydraulic motor of the VRREC to rotate. The speed of rotation will be dependent and directly related to the energy requirement of the BOP. The VRREC variable displacement motor will rotate with sufficient speed that meets or exceeds the demand of the BOP. The variable displacement motor is mechanically coupled to the variable displacement hydraulic pump of the VRREC. As the VRREC rotates the VRREC variable displace pump receives hydraulic fluid from container 64. The hydraulic fluid received from container 64 is intensified to a level that meets or exceeds the requirement of the BOP system. The intensified hydraulic fluid is supplied to the BOP system 67 including safety devices 68, 69 and 70 via the high pressure discharge port of the pump portion of the VRREC.

Figure 5:
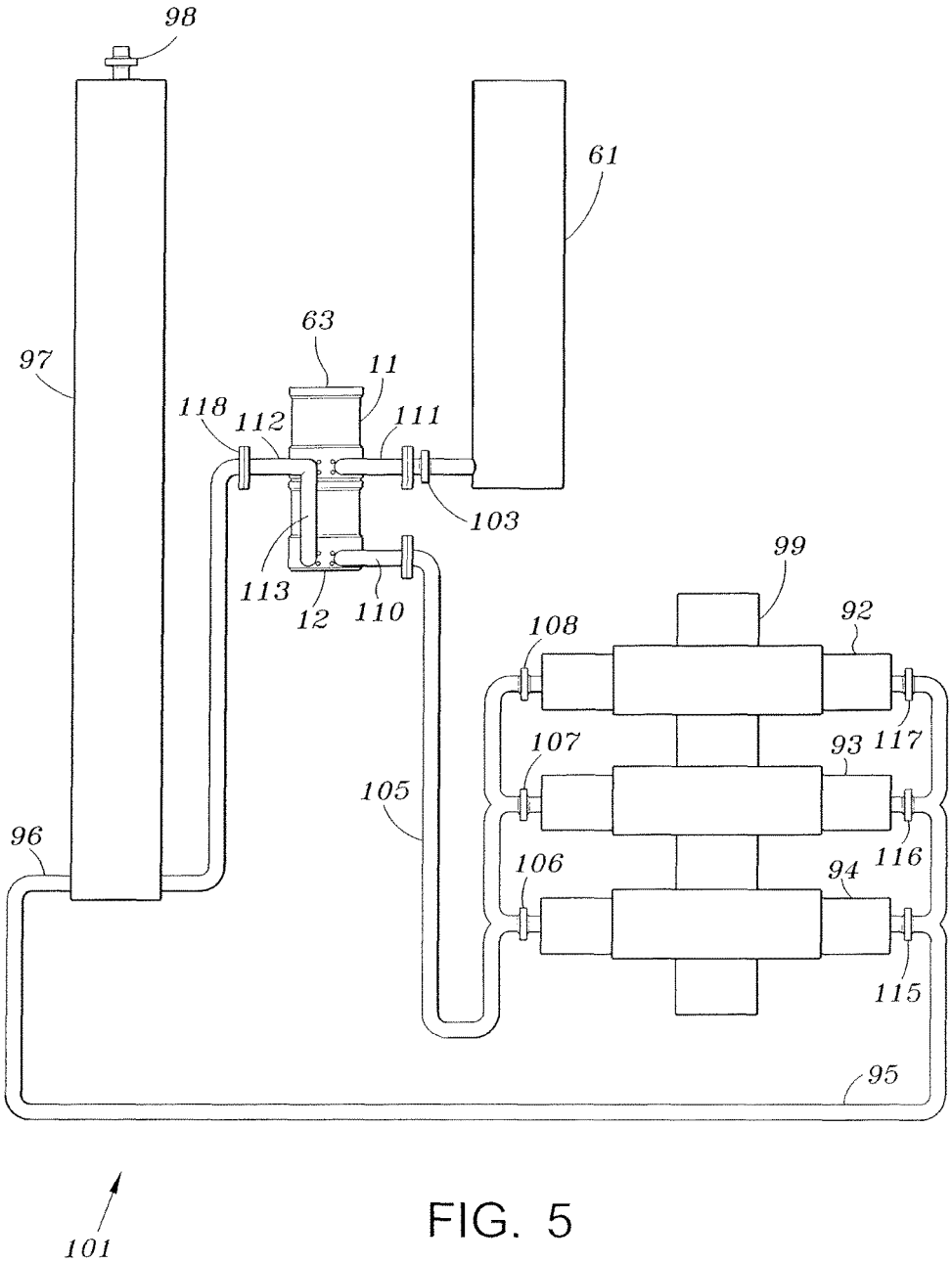
FIG. 5 is a diagram of a rechargeable fluid pressure system for a blowout preventer using a variable ratio rotary energy controller according to a second embodiment of the invention.
Figure 7:
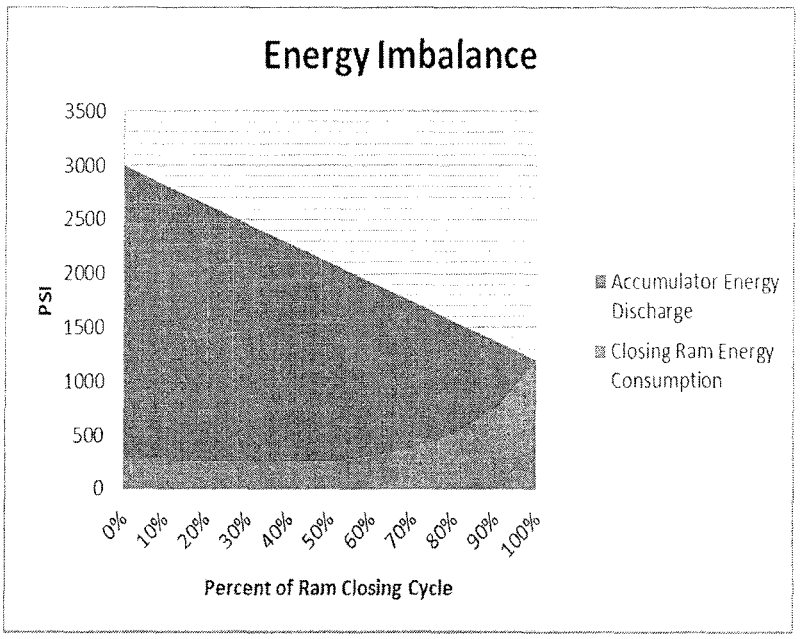
FIG. 7 is a graph that depicts the energy relationship between the accumulator rack and the BOP ram.

A third embodiment of the invention is illustrated in FIG. 5. This embodiment is similar to that shown in FIGS. 3 and 4 and is designed to be rechargeable as will be discussed below. The system includes a vessel 61 similar to that shown in FIG. 4 which includes a floating piston 83 and an outlet port 89 at the bottom portion of the vessel. Space 82 is filled with hydraulic fluid. When valve 103 is opened, the hydraulic fluid will be forced out of vessel 61 to the motor portion 11 of the VRREC. As in the embodiment of FIGS. 3 and 4, fluid exiting the motor portion can be directed to container 97 via conduit 112 or to the input of the pump portion 12 of the VRREC through conduit 113. In this embodiment container 97 is designed to receive hydraulic fluid from vessel 61 and to supply hydraulic fluid to the VRREC during normal operations. Container 97 also receives hydraulic fluid that is discharged from the blowout preventer via conduits 94 and 95 through valves 115, 116 and 117.

In the normal ready to operate state, pressure in the container 97 is near zero psi and principally void. When control valve 103 is opened, hydraulic fluid will pass from vessel 61 through the VRREC and into container 97.

Hydraulic fluid will enter the motor portion of the VRREC causing the motor to rotate which will in turn drive the pump portion 12 of the VRREC. The speed of rotation of the variable displacement hydraulic motor portion will be dependent on and directly related to the energy requirement of the blowout preventer. The variable displacement pump 12 will receive hydraulic fluid from the container 97 as the motor portion 11 rotates. The pressure of the fluid received from container 97 is intensified to a level that meets or exceeds the requirements of the blowout preventer system. Vessel 61 is discharged when piston 83 has been displaced towards the closed end of the vessel and has activated a piston sensor 90 located near the bottom of vessel 61.

To recharge the system a pressure control valve 103 between vessel 61 and VRREC 63 would be opened. Also, evacuation valve 98 would be opened. At the sea surface, a high pressure gas such as air for example, is introduced into container 97 via evacuation valve 98. As the high pressure gas fills container 97, hydraulic fluid within the container will be displaced back into vessel 61 via VRREC 63 via conduits 112 and 111. During this recharge cycle, the viable displacement pump portion 12 of the VRREC will be commanded to zero displacement via a signal from the high pressure gas introduced into container 97. Floating piston 83 will be displaced to an upper portion of vessel 61. A piston sensor 91 located at the top of vessel 61 will sense when the floating piston is at the top portion of vessel 61. The sensor will send a signal that will close pressure flow control valve 103 and isolate the high pressure source at sea level and also vent container 97 to atmospheric pressure. At this point a vacuum source can be connected to container 97 to reduce the internal pressure to near zero psi. The vaccum source is then disconnected from container 97. The system is now ready for reuse.

Two or more Hydraulic Supply Systems each with a VRREC could be connected to a single BOP system, ensuring that there would be a fully charge Hydrostatic Pressure Driven Hydraulic Supply System with VRREC on line and ready to close the BOP safety devices if needed.

Although the present invention has been described with respect to specific details, it is not intended that such details should be regarded as limitations on the scope of the invention, except to the extent that they are included in the accompanying claims.

What is claimed is:

1. A variable ratio rotary energy control system for supplying fluid under pressure to a safety device of a blowout preventer comprising:

a source of fluid under pressure;

a variable ratio rotary energy control device comprising a variable displacement hydraulic motor portion having an output power shaft, a fluid input port and a fluid output port; a variable displacement hydraulic pump portion having an input power shaft; and a mechanical coupling between the motor output power shaft and the input power shaft of the pump;

a conduit connected between the source of fluid under pressure and the fluid input port of the motor portion of the variable ratio rotary control device;

a valve position within the conduit; wherein the variable displacement hydraulic motor portion includes a fluid outlet which is connected to a fluid inlet port of the variable displacement pump portion; and the pump portion including said fluid inlet port and a fluid outlet, the fluid outlet of the pump being connected to a fluid inlet of the blowout preventer safety device.

2. A variable ratio rotary energy control system as claimed in claim 1 wherein the source of fluid under pressure includes one or more tanks filled with hydraulic fluid and connected to a source of gas under pressure.

3. A variable ratio rotary energy control system as claimed in claim 1 where in the source of fluid under pressure includes a vessel containing hydraulic fluid, an outlet port at a bottom of the vessel and a floating piston.

4. A variable ratio rotary energy control system as claimed in claim 1 further including a fluid container, the fluid outlet port of the motor portion being connected to the container.

5. A variable ratio rotary energy control system as claimed in claim 4 further including a fluid conduit extending between the fluid container and the safety device of the blowout preventer.

6. A variable ratio energy control device comprising:

a variable displacement hydraulic fluid motor including a fluid inlet, a fluid outlet and a drive shaft;

a variable displacement hydraulic fluid pump having a fluid inlet, a fluid outlet and an input drive shaft;

the motor drive shaft and the pump input drive shaft being coupled to each other and the fluid outlet of the variable displacement hydraulic fluid motor being connected to the fluid inlet of the variable displacement hydraulic fluid pump by a conduit, wherein the conduit between the fluid outlet of the variable displacement outlet motor and the input of the variable displacement hydraulic pump includes a "T" portion for connection to an accumulator for hydraulic fluid.

7. A method of controlling the operation of a safety device of a blowout preventer, the safety device being operated by hydraulic fluid under pressure comprising:

providing a source of fluid under pressure;

providing a variable ratio rotary energy controller connected between the source of fluid under pressure and the safety device; and initiating the flow of fluid under pressure to the safety device of the blowout preventer through the variable ratio rotary energy controller, wherein the variable ratio rotary control device includes a variable displacement hydraulic motor having an input port and an outlet port, an output shaft connected to an input shaft of a variable displacement hydraulic pump, the pump including an inlet port and an outlet port, and directing fluid from the variable displacement hydraulic motor outlet port to the fluid inlet port of the variable displacement hydraulic pump.

8. A method of controlling the operation of a safety device of a blowout preventer, the safety device being operated by hydraulic fluid under pressure comprising:

providing a source of fluid under pressure;

providing a variable ratio rotary energy controller connected between the source of fluid under pressure and the safety device;

initiating the flow of fluid under pressure to the safety device of the blowout preventer through the variable ratio rotary energy controller, and providing a fluid container for receiving hydraulic fluid from the variable ratio energy controller and the safety device of the blowout preventer and directing the hydraulic fluid in the fluid container back to the source of fluid under pressure thereby recharging the system for subsequent use.

* * * * *